US009766563B2

(12) United States Patent
Kouyama et al.

(10) Patent No.: US 9,766,563 B2
(45) Date of Patent: Sep. 19, 2017

(54) TONER AND PROCESS FOR PRODUCING THE SAME

(71) Applicant: Konica Minolta, Inc., Tokyo (JP)

(72) Inventors: Mikio Kouyama, Tokyo (JP); Hiroyuki Fukuda, Hyogo (JP); Shiro Hirano, Tokyo (JP); Asao Matsushima, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 125 days.

(21) Appl. No.: 14/796,530

(22) Filed: Jul. 10, 2015

(65) Prior Publication Data

US 2016/0011532 A1 Jan. 14, 2016

(30) Foreign Application Priority Data

Jul. 14, 2014 (JP) ..... 2014-144204

(51) Int. Cl.
*G03G 9/087* (2006.01)
*G03G 9/08* (2006.01)

(52) U.S. Cl.
CPC ..... *G03G 9/0806* (2013.01); *G03G 9/08711* (2013.01); *G03G 9/08764* (2013.01); *G03G 9/08795* (2013.01); *G03G 9/08797* (2013.01)

(58) Field of Classification Search
CPC ..... G03G 9/08797; G03G 9/08795; G03G 9/08764; G03G 9/08755; G03G 9/08711; G03G 9/0806; G03G 9/0804
USPC ..... 430/109.4, 109.3
See application file for complete search history.

(56) References Cited

U.S. PATENT DOCUMENTS

2011/0212398 A1* 9/2011 Hayashi ..... G03G 9/0804 430/109.3
2014/0272699 A1* 9/2014 Minaki ..... G03G 9/08764 430/109.3
2015/0234306 A1* 8/2015 Kouyama ..... G03G 9/08764 430/109.4

FOREIGN PATENT DOCUMENTS

JP 2011-197659 A 10/2011
JP 2012133161 A 7/2012

OTHER PUBLICATIONS

Notice of Reasons for Rejection dated Sep. 6, 2016 from corresponding Japanese Application; Japanese Patent Application No. 2014-144204; English translation of Notice of Reasons for Rejection; Total of 9 pages.

* cited by examiner

*Primary Examiner* — Janis L Dote
(74) *Attorney, Agent, or Firm* — Lucas & Mercanti, LLP

(57) ABSTRACT

The toner according to the present invention is used for electrostatic latent image development, and has toner particles containing a binder resin, a colorant and a release agent. The binder resin is composed of a non-crystalline resin and a crystalline resin. The toner satisfies the relationship represented by specific expressions specified by the endothermic property of the crystalline resin, the endothermic property of the toner and the content ratio of the binder resin in the toner particles.

7 Claims, No Drawings

TONER AND PROCESS FOR PRODUCING THE SAME

CROSS REFERENCE TO RELATED APPLICATIONS

This application is entitled to and claims the benefit of Japanese Patent Application No. 2014-144204, filed on Jul. 14, 2014, the disclosure of which including the specification, drawings and abstract is incorporated herein by reference in its entirety.

BACKGROUND OF THE INVENTION

Field of the Invention

The present invention relates to an electrostatic latent image developing toner for forming an electrophotographic image, and a process for producing the same.

Description of Related Art

An electrostatic latent image developing toner (hereinafter, also referred simply as "toner") for forming an electrophotographic image is desired to be more excellent in low temperature fixability for saving energy for an image-forming apparatus and speeding up an image-forming process by the apparatus. Known examples of such a toner include a toner designed such that a binder resin has a lower glass transition point and a lower softening point by allowing toner particles to contain a crystalline polyester resin having a sharp-melting property as the binder resin.

However, such a toner containing the crystalline polyester resin having a lower glass transition point and a lower softening point has a problem of insufficient high-temperature storability due to easy occurrence of heat fusion of the toner particles, while such a toner has low temperature fixability. In addition, a fixed image constituted by the resin also has a problem of causing document offset due to the lower glass transition point and the lower softening point of the resin.

In order to solve these problems, a toner is proposed which is composed of toner particles in which particles are laminated on the surface of a toner base particle, the particles comprising a urethane-modified crystalline polyester resin in which a urethane polymerization segment is bonded to a polyester polymerization segment (see, e.g., Japanese Patent Application Laid-Open No. 2012-133161).

However, in the toner disclosed in PTL 1, the crystalline polyester resin component that contributes to the low temperature fixability is laminated on the surface of the toner base particle, and thus the addition amount thereof has an upper limit. Accordingly, the toner disclosed in PTL 1 has problems in which a sufficient sharp-melting property is not exerted, and further the low melting point and the low melt viscosity thereof causes aggregation and fusion of toner particles during storage of the toner, which leads to thermal aggregation of the toner, resulting in insufficient high-temperature storability.

SUMMARY OF THE INVENTION

The present invention has been achieved in light of the above-described circumstances, and an object of the present invention is to provide a toner for developing an electrostatic latent image and a process for producing the same, the toner having both excellent low temperature fixability and sufficient high-temperature storability, suppressing the occurrence of cold offset and hot offset to have a broader fixing temperature window, and being able to form a fixed image which does not cause document offset or tacking.

The present invention provides, as a means for achieving the object, a toner for developing an electrostatic latent image, comprising toner particles containing a binder resin, a colorant, and a release agent, in which the binder resin comprises a non-crystalline resin and a crystalline resin, and the toner satisfying the following Expressions (1) and (2):

$$0.95 \leq (\Delta Ht2/\Delta Ht1)/(\Delta Ho2/\Delta Ho1) \leq 1.0 \quad \text{Expression (1)}$$

$$0.9 \leq \Delta Htc/(\Delta Hoc \times A/100) \leq 1.0. \quad \text{Expression (2)}$$

In the above expressions, ΔHo1 represents the endotherm (J/g) of the crystalline resin determined by a melting peak in a first differential scanning calorimetry (DSC) curve of the crystalline resin, the first DSC curve obtained in a first heating process of elevating the temperature of the crystalline resin from 0° C. to 200° C. by DSC, ΔHoc represents the endotherm (J/g) of the crystalline resin determined by a melting peak in the first DSC curve obtained in a cooling process of lowering the temperature of the crystalline resin from 200° C. to 0° C., and ΔHo2 represents the endotherm (J/g) of the crystalline resin determined by a melting peak in the first DSC curve obtained in a second heating process of elevating the temperature of the crystalline resin from 0° C. to 200° C.

In addition, in the above expressions, ΔHt1 represents the endotherm (J/g) of the crystalline resin in the toner particles determined by a melting peak in a second DSC curve of the toner particles obtained in a first heating step of elevating the temperature of the toner particles from 0° C. to 200° C. by DSC, ΔHtc represents the endotherm (J/g) of the crystalline resin in the toner particles determined by a melting peak in the second DSC curve obtained in a cooling step of lowering the temperature of the toner particles from 200° C. to 0° C., ΔHt2 represents the endotherm (J/g) of the crystalline resin in the toner particles determined by a melting peak in the second DSC curve obtained in a second heating step of elevating the temperature of the toner particles from 0° C. to 200° C., and A represents the content ratio (% by mass) of the crystalline resin in the toner particles.

In the toner, it is preferable that the crystalline resin is a urethane-modified crystalline resin in which a urethane polymerization segment is bonded to a crystalline polymerization segment, and that a peak temperature of the melting peak in the first DSC curve obtained in the second heating process is within the range of 60° C. to 90° C.

In the toner, it is preferable that the urethane-modified crystalline resin is a urethane-modified crystalline polyester resin in which the crystalline polymerization segment thereof comprises a crystalline aliphatic polyester polymer.

In the toner, it is preferable that one or both of at least one polymer terminal of the urethane-modified crystalline polyester resin and the urethane polymerization segment of the urethane-modified crystalline polyester resin has a carboxyl group, and that the acid value of the urethane-modified crystalline polyester resin is within the range of 7 to 20 mgKOH/g.

In the toner, it is preferable that the non-crystalline resin comprises a vinyl resin, and the toner satisfies the following Expression (3):

$$TgAm < TmCl \quad \text{Expression (3)}$$

where, TgAm represents a glass transition point of the non-crystalline resin, and TmCl represents a peak temperature of the melting peak of the crystalline resin obtained in the second heating process.

A process for producing the toner includes the steps of aggregating and fusing microparticles containing the binder resin, microparticles containing the colorant, and microparticles containing the release agent dispersed in an aqueous medium.

In the process for producing the toner, it is preferable to include a step of adding a monomer for forming the non-crystalline resin into an aqueous medium in the presence of microparticles of the crystalline resin and polymerizing the monomer to afford the microparticles containing the binder resin.

In the process for producing the toner, it is preferable to include a step of adding a monomer for the non-crystalline resin into an aqueous medium in the presence of both microparticles of the crystalline resin and microparticles of the release agent and polymerizing the monomer to afford both the microparticles containing the binder resin and the microparticles containing the release agent simultaneously.

Alternatively, a process for producing the toner includes the steps of aggregating and fusing microparticles containing the binder resin and the release agent, and microparticles containing the colorant dispersed in an aqueous medium.

The process for producing the toner preferably includes a step of adding a monomer for forming the non-crystalline resin into an aqueous medium in the presence of microparticles comprising both the emulsified crystalline resin and a release agent and polymerizing the monomer to afford the microparticles containing both the binder resin and the release agent.

DESCRIPTION OF THE PREFERRED EMBODIMENTS

Hereinafter, the present invention will be described specifically.

A toner according to an embodiment of the present invention comprises toner particles containing a binder resin comprising a non-crystalline resin and a crystalline resin, a colorant and a release agent, and has the following thermal property.

[Thermal Property of Toner]

The toner satisfies the following Expressions (1) and (2):

$$0.95 \leq (\Delta Ht2/\Delta Ht1)/(\Delta Ho2/\Delta Ho1) \leq 1.0 \quad \text{Expression (1)}$$

$$0.9 \leq \Delta Htc/(\Delta Hoc \times A/100) \leq 1.0. \quad \text{Expression (2)}$$

In the above expressions, ΔHo1 represents the endotherm (J/g) of the crystalline resin determined by a melting peak in a first differential scanning calorimetry (DSC) curve of the crystalline resin, the first DSC curve obtained in a first heating process of elevating the temperature of the crystalline resin from 0° C. to 200° C. by DSC. ΔHoc represents the endotherm (J/g) of the crystalline resin determined by a melting peak in the first DSC curve obtained in a cooling process of lowering the temperature of the crystalline resin from 200° C. to 0° C. ΔHo2 represents the endotherm (J/g) of the crystalline resin determined by a melting peak in the first DSC curve obtained in a second heating process of elevating the temperature of the crystalline resin from 0° C. to 200° C.

In addition, in the above expressions, ΔHt1 represents the endotherm (J/g) of the crystalline resin in the toner particles determined by a melting peak in a second DSC curve of the toner particles obtained in a first heating step of elevating the temperature of the toner particles from 0° C. to 200° C. by DSC. ΔHtc represents the endotherm (J/g) of the crystalline resin in the toner particles determined by a melting peak in the second DSC curve obtained in a cooling step of lowering the temperature of the toner particles from 200° C. to 0° C. ΔHt2 represents the endotherm (J/g) of the crystalline resin in the toner particles determined by a melting peak in the second DSC curve obtained in a second heating step of elevating the temperature of the toner particles from 0° C. to 200° C.

Further, in the above expressions, A represents the content ratio (% by mass) of the crystalline resin in the toner particles.

The value of (ΔHt2/ΔHt1)/(ΔHo2/ΔHo1) of Expression (1) is preferably $0.96 \leq (\Delta Ht2/\Delta Ht1)/(\Delta Ho2/\Delta Ho1) \leq 1.0$. In addition, the value of ΔHtc/(ΔHoc×A/100) of Expression (2) is preferably $0.92 \leq \Delta Htc/(\Delta Hoc \times A/100) \leq 1.0$.

Expression (1) indicates that the ratio between the endotherm of the single crystalline resin in the first and second heating processes is hardly different from the ratio between the endotherm of the crystalline resin in toner particles in the first and second heating steps. In other words, it means that the crystalline resin and the non-crystalline resin are almost incompatible.

Expression (2) indicates that the exotherm of the exothermic peak of the crystalline resin in the toner particles in the cooling step is hardly different from the exotherm of the exothermic peak of the crystalline resin in the cooling process. In other words, it means that the crystalline resin is sufficiently recrystallized when the toner particles are cooled after heat fixing.

Accordingly, satisfying both Expressions (1) and (2) allows the crystalline resin and the non-crystalline resin that constitute the binder resin to be incompatible with each other during storage of the toner, and allows the crystalline resin to be sufficiently recrystallized when being cooled while they become compatible once during heat fixing, and thus the crystalline resin and the non-crystalline resin become incompatible again in a fixed image. Therefore, it is possible to securely achieve a sharp-melting property due to the compatiblization (the state where both the resins are compatibilized) of both the resins during the heat fixing, while suppressing the occurrence of document offset or tacking due to the phase separation between both the resins in a fixed image after the heat fixing.

DSC of the toner is carried out using "Diamond DSC (manufactured by PerkinElmer Co., Ltd.)" with measuring conditions (temperature elevating/cooling conditions) of undergoing: a first heating process (or step) in which the temperature of the sample is elevated from 0° C. to 200° C. at a elevating rate of 10° C./min. followed by holding the temperature constant at 200° C. for 1 minute; a cooling process in which the temperature is lowered from 200° C. to 0° C. at a cooling rate of 10° C./min. followed by holding the temperature constant at 0° C. for 1 minute; and a second heating process (or step) in which the temperature is elevated from 0° C. to 200° C. at a elevating rate of 10° C./min.; in this order. In this measuring procedure, 3.0 mg of, for example, toner is sealed in an aluminum-made pan, which is then placed in a sample holder of "Diamond DSC." As a reference, an empty aluminum-made pan is used.

DSC for the crystalline resin alone is carried out in the same manner as mentioned above using as a measurement sample a crystalline resin that was isolated and extracted from the toner. As the method of extracting and isolating the crystalline resin from the toner, it is possible to employ a method disclosed, for example, in Japanese Patent No. 3869968.

The mass ratio of the crystalline resin in the toner particle can be measured by NMR analysis.

Specifically, the value of ΔHo2 is preferably 40 to 100 J/g.

The values of ΔHo1, ΔHo2 and ΔHoc can be controlled by the composition of the crystalline resin.

The values of ΔHt1 and ΔHtc can be controlled by the composition of the non-crystalline resin or crystalline resin, the cooling method during producing the toner, or the like.

The value of ΔHt2 can be controlled by the composition of the non-crystalline resin or crystalline resin.

The content ratio between the crystalline resin and the non-crystalline resin (mass of crystalline resin: mass of non-crystalline resin) in a binder resin is preferably 10:90 to 50:50, more preferably 20:80 to 40:60, and even more preferably 25:75 to 35:65. When the content ratio of the crystalline resin in the binder resin is 10% by mass or more, a sufficient sharp-melting property is achieved, enabling low temperature fixability to be securely achieved. In addition, when the content ratio of the crystalline resin in the binder resin is 50% by mass or less, the exposure of the crystalline resin at the surface of the toner particles is suppressed, enabling the high-temperature storability and the blocking resistance to be securely achieved.

[Crystalline Resin]

In the present invention, the crystalline resin does not mean a resin having a stepwise variation of an endothermic energy amount, but means a resin having a clear melt peak, in DSC. Specifically, the clear melt peak means a peak in which the half-value width of a melting peak in the second heating process is within 15° C., in the first DSC curve obtained by DSC.

The crystalline resin constituting the binder resin according to the present invention is preferably a urethane-modified crystalline resin in which a urethane polymerization segment is bonded to a crystalline polymerization segment, and is more preferably a urethane-modified crystalline polyester resin (hereinafter, also referred to as "UMCP") in which the crystalline polymerization segment is composed of a urethane polymerization segment is bonded to a crystalline aliphatic polyester polymer, i.e., in which a crystalline polyester polymerization segment.

UMCP has a strong intermolecular interaction due to the presence of a urethane bond compared with the crystalline polyester resin which is not urethane-modified. Accordingly, when the crystalline resin constituting the binder resin is UMPC, the binder resin as a whole maintains sufficient viscoelasticity even when the temperature is elevated during heat fixing, and thus it is possible to inhibit the glossiness of a formed fixed image from being excessively high. In addition, the strong intermolecular interaction provides UMCP with the property of phase separation from the non-crystalline resin composed of a vinyl resin during storage of the toner and in a cooled fixed image after the heat fixing, enabling sufficient high-temperature storability and document offset resistance to be achieved.

Hereinafter, descriptions will be given on the case where the crystalline resin is UMCP.

[Melting Point of UMCP]

The melting point of UMCP is preferably 60° C. to 90° C., and more preferably 50° C. to 85° C. When the melting point of UMCP is within the above range, sufficient low temperature fixability is securely achieved. The melting point of UMCP can be controlled by the compositions of a polyvalent carboxylic acid and a polyvalent alcohol.

The melting point of UMCP is a peak top temperature of the melting peak in the second heating process in the first DSC curve obtained by DSC of UMCP. It is noted that when there is a plurality of melting peaks in the first DSC curve, the peak top temperature of the melting peak having the maximum endotherm is set as the melting point of UMCP.

[Molecular Weight of UMCP]

The weight-average molecular weight (Mw) calculated from the molecular weight distribution to be measured by gel permeation chromatography (GPC) of UMCP is preferably 25,000 to 65,000, and more preferably 28,000 to 60,000.

The measurement of the molecular weight using GPC is carried out as follows. That is, an apparatus "HLC-8220" (manufactured by Tosoh Corporation) and a column "TSK guard column+TSK gel Super HZM-M 3 series" (manufactured by Tosoh Corporation) are used. Tetrahydrofuran (THF) is flowed as a carrier solvent at a flow rate of 0.2 ml/min. while holding the column temperature at 40° C. and a measurement sample (UMCP) is dissolved into THF in a dissolving condition of carrying out 5-minute treatment using an ultrasonic disperser at room temperature so as to have a concentration of 1 mg/ml, followed by a treatment with a membrane filter having a pore size of 0.2 μm to give a sample solution. 10 μm of the sample solution is then injected into the apparatus together with the above carrier solvent, and a refractive index detector (RI detector) is used for detection to calculate the molecular weight distribution of the measurement sample using a calibration curve measured using monodisperse polystyrene standard particles. As the standard polystyrene sample for measurement of the calibration curve, standard polystyrene samples (manufactured by Pressure Chemical Company) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ are used, and at least about 10 standard polystyrene samples are measured to prepare a calibration curve using a refractive index detector as the detector.

In addition, the weight-average molecular weight (Mw) of a crystalline polyester polymerization segment (hereinafter, also referred to as "CPPS") is preferably 6,000 to 20,000, and more preferably 6,500 to 15,000. CPPS constitutes UMCP, and Mw of CPPS is calculated from the molecular weight distribution to be measured by gel permeation chromatography (GPC) of CPPS.

When the weight-average molecular weight (Mw) of CPPS is 6,000 or more, sufficient crystallinity is achieved, thereby enabling a desired sharp-melting property to be achieved. In addition, when the weight-average molecular weight (Mw) of CPPS is 20,000 or less, a sufficient number of intramolecular urethane bonds is secured in UMCP to enable sufficient intermolecular interaction to be achieved.

The molecular weight distribution of CPPS is measured by GPC in the same manner as mentioned above except that CPPS is used as a measurement sample.

In addition, the weight-average molecular weight (Mw) of a urethane polymerization segment (hereinafter, also referred to as "UPS") is preferably 500 to 50,000, and more preferably 1,000 to 10,000. UPS constitutes UMCP, and Mw of UPS is calculated from the molecular weight distribution to be measured by gel permeation chromatography (GPC) of UPS. The molecular weight distribution of UPS is measured by GPC in the same manner as mentioned above except that UPS is used as a measurement sample.

The content ratio of CPPS in UMCP is preferably 50 to 99.5% by mass, more preferably 60 to 96% by mass, and even more preferably 60 to 90% by mass.

Specifically, the content ratio of CPPS is a ratio of the mass of a polyvalent carboxylic acid and a polyvalent alcohol that becomes CPPS to the total mass of a resin material to be used for synthesizing UMCP, i.e., the total mass of: the polyvalent carboxylic acid and the polyvalent alcohol that becomes CPPS; and, a polyvalent alcohol and a polyvalent isocyanate that becomes UPS.

When the content ratio of CPPS is 50% by mass or more, sufficient a sharp-melting property can be achieved, and thus excellent low temperature fixability can be achieved. In addition, when the content ratio of CPPS is 99.5% by mass or less, the binder resin as a whole maintains sufficient viscoelasticity even when the temperature is elevated during heat fixing, and thus it is possible to inhibit the glossiness of a formed fixed image from being excessively high, and to achieve sufficient document offset resistance.

[Acid Value of UMCP]

The acid value of UMCP is preferably 7 to 20 mgKOH/g, and more preferably 9 to 17 mgKOH/g.

When the acid value of UMCP is within the above range, the compatiblization between the non-crystalline resin and UMCP constituting the binder resin occurring during heat fixing can be accelerated by the polarity of the carboxyl group of UMCP. In addition, it is possible to properly control the dispersion stability of microparticles of UMCP in an aqueous medium in the process for producing the toner to be described later.

The acid value of UMCP is measured in accordance with the method of measuring an acid value disclosed in JIS K 0070. Specifically, UMCP is dissolved into a mixed solvent of acetone:water=1:1, and neutralization titration is carried out using potassium hydroxide according to the usual method, so that the acid value of UMCP is indicated by the weight of potassium hydroxide used until the end point of neutralization per gram of UMCP. The unit is mgKOH/g.

When, in UMCP, a carboxyl group is introduced to one or both of at least one polymer terminal of UMCP and UPS constituting UMCP, UMCP has an acid value.

Specifically, a carboxyl group can be introduced to the polymer terminal of UMCP by allowing a polyvalent carboxylic acid compound to undergo an esterification reaction with a hydroxyl group of the polymer terminal of a conjugate of CPPS and UPS to form UMCP. Examples of the polyvalent carboxylic acid compound include divalent carboxylic acids such as fumaric acid, succinic acid, maleic acid, itaconic acid and adipic acid; trivalent carboxylic acids such as trimellitic acid and citric acid; and acid anhydrides thereof. As the polyvalent carboxylic acid compound, it is preferable to use the trivalent carboxylic acid, and it is particularly preferable to use trimellitic acid anhydride. The esterification reaction can be carried out in the presence of a catalyst. The examples of the catalyst include tetrabutoxy titanate, dibutyltin oxide, and p-toluenesulfonic acid.

In addition, it is possible to introduce a carboxyl group into UPS, for example, by carrying out urethanization reaction using a diol compound having a carboxyl group as a polyvalent alcohol to form UPS. Examples of the diol compound having a carboxyl group include dimethylol acetic acid, dimethylol propionic acid, dimethylol butanoic acid, dihydroxy succinic acid, tartaric acid, glyceric acid, and dihydroxy benzoic acid.

Examples of the reaction solvent for esterification reaction and urethanization reaction include ketone-based solvents such as acetone, methyl ethyl ketone, and methyl isobutyl ketone. In addition, it is also preferable to use N-methylpyrrolidone for dissolving the diol compound. The reaction solvent is preferably dehydrated and purified for preventing a side reaction from occurring.

[Method for Synthesizing UMCP]

UMCP can be synthesized by synthesizing, in advance, both a prepolymer, to become CPPS, having a hydroxyl group at both terminals (such as a crystalline polyester diol to be described later) and a polyurethane unit having an isocyanate group at its terminal, and mixing the prepolymer and the polyurethane unit to allow them to react (synthesis reaction A).

Alternatively, UMCP can also be synthesized by first synthesizing a prepolymer, which becomes CPPS, having a hydroxyl group at both terminals (such as a crystalline polyester diol to be described later), and then allowing only a polyvalent isocyanate compound or a polyvalent isocyanate compound and a polyvalent alcohol to react with a hydroxyl group at both terminals of the prepolymer (synthesis reaction B) to form USP.

The synthesis reaction A is carried out in a solvent capable of dissolving both the prepolymer having a hydroxyl group at both terminals and the polyurethane unit having an isocyanate group at its terminal. Likewise, the synthesis reaction B is carried out in a solvent capable of dissolving the prepolymer, having a hydroxyl group at both terminals, the polyvalent isocyanate compound and the polyvalent alcohol. Examples of such a reaction solvent include ketone-based solvents such as acetone, methyl ethyl ketone, and methyl isobutyl ketone. The reaction solvent is preferably dehydrated and purified for preventing a side reaction from occurring.

In addition, the synthesis reactions A and B are preferably carried out under warming for accelerating the synthesis reaction. The reaction temperature is preferably 50° C. to 80° C., although it varies depending on the boiling points of solvents.

[CPPS]

CPPS is composed of a crystalline polyester polymer, and is preferably composed of a crystalline polyester diol (hereinafter, also referred to as "CPDO").

CPDO is a crystalline compound formed of a polyvalent carboxylic acid containing two or more carboxyl groups in one molecular and a polyvalent alcohol containing two or more hydroxyl groups in one molecular and having a hydroxyl group in both terminals thereof, and specifically a compound not having a melting peak because of a stepwise variation of endotherm in DSC but a clear melting peak in DSC.

In particular, CPDO is preferably a compound in which one diol as the polyvalent alcohol and one dicarboxylic acid as the polyvalent carboxylic acid are polycondensed. When CPDO is a polycondensate of a plurality of diols and of dicarboxylic acids, there is concern that a peak width of a melting peak to be observed in the DSC curve may become undesirably wider, or that a plurality of melting peaks may be undesirably observed depending on the types of the generated crystalline polyester units. UMCP formed of CPDO having such a melting peak with a wider peak width or with a plurality of melting peaks becomes easily compatible with a non-crystalline resin, and recrystallization of UMCP and phase separation in the binder resin do not easily occur.

As the polyvalent carboxylic acid, an aliphatic dicarboxylic acid is preferably used, and an aromatic dicarboxylic acid may also be used in combination.

As the polyvalent carboxylic acid, it is preferable to use a straight chain aliphatic dicarboxylic acid having 4 to 12 carbon atoms, including a carboxyl group, in the main chain, and particularly preferably 6 to 10, from the viewpoint of being able to impart excellent crystallinity to CPPS. The polyvalent carboxylic acids may be used singly or in combination.

Examples of the aliphatic dicarboxylic acid include saturated aliphatic dicarboxylic acids such as oxalic acid, malonic acid, fumaric acid, succinic acid, adipic acid, azelaic acid, sebacic acid, dodecanedioic acid and n-dodecyl succinic acid, anhydrides thereof, and alkyl esters thereof having 1 to 3 carbon atoms. The aliphatic dicarboxylic acids may be used singly or in combination.

Examples of the polyvalent carboxylic acid other than the aliphatic dicarboxylic acid include aromatic dicarboxylic acids such as phthalic acid, isophthalic acid, and terephthalic acid; trivalent or higher-valent polyvalent carboxylic acids such as trimellitic acid, and pyromellitic acid; anhydrides thereof; and alkyl esters thereof having 1 to 3 carbon atoms.

The polyvalent carboxylic acid for forming CPDO has the aliphatic carboxylic acid content of preferably 80% by mol or more, and more preferably 90% by mol or more. When the aliphatic carboxylic acid content in the polyvalent carboxylic acid is 80% by mol or more, the crystallinity of CPDO can be secured, and excellent low temperature fixability is imparted to the toner to be produced.

As the polyvalent alcohol, an aliphatic diol is preferably used, and a diol other than the aliphatic diol may be used in combination as necessary.

As the polyvalent alcohol, it is preferable to use a straight chain aliphatic diol having 2 to 15, particularly preferably 2 to 10, carbon atoms in the main chain, among aliphatic diols from the viewpoint of being able to impart excellent crystallinity to CPPS. The polyvalent alcohols may be used singly or in combination.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,18-octadecanediol, and 1,20-eicosanediol. The aliphatic diols may be used singly or in combination.

Examples of the polyvalent alcohol other than the aliphatic diol include trivalent or higher-valent polyvalent alcohols such as glycerol, pentaerythritol, trimethylolpropane, and sorbitol.

The polyvalent alcohol for forming CPDO has the aliphatic diol content of preferably 80% by mol or more, and more preferably 90% by mol or more. When the aliphatic diol content in the polyvalent alcohol is 80% by mol or more, the crystallinity of CPDO can be secured, and excellent low temperature fixability is imparted to the toner to be produced.

The process for producing CPDO is not limited, and CPDO can be produced by using a common method for polymerizing a polyester in which a polyvalent carboxylic acid is reacted with a polyvalent alcohol in the presence of a catalyst as described above. For example, it is preferable to use direct polycondensation and ester exchange method appropriately depending on the types of monomers for CPDO.

Examples of the catalyst that can be used for producing CPDO include titanium catalysts such as titanium tetraethoxide, titanium tetrapropoxide, titanium tetraisopropoxide, and titanium tetrabutoxide, and tin catalysts such as dibutyl tin dichloride, dibutyl tin oxide, and diphenyl tin oxide.

As for the usage ratio between the polyvalent carboxylic acid and the polyvalent alcohol, the equivalent ratio of a hydroxyl group [OH] of the polyvalent alcohol to a carboxyl group [COOH] of the polyvalent carboxylic acid ([OH]/[COOH]) is preferably 1.5/1 to 1/1.5, and more preferably 1.2/1 to 1/1.2.

When the usage ratio between the polyvalent carboxylic acid and the polyvalent alcohol is within the above range, it is possible to give CPDO having hydroxyl groups at both terminals thereof.

[UPS]

UPS can be obtained from a polyvalent alcohol and a polyvalent isocyanate.

As the polyvalent alcohol that can be used for forming UPS, a polyvalent alcohol similar to those as mentioned above can be used.

The polyvalent alcohols for UPS may be used singly or in combination.

Examples of the polyvalent isocyanate that can be used for forming UPS include an aromatic diisocyanate having 6 to 20 carbon atoms (excluding a carbon in NCO group), an aliphatic diisocyanate having 2 to 18 carbon atoms (excluding a carbon in NCO group), an alicyclic diisocyanate having 4 to 15 carbon atoms (excluding a carbon in NCO group), an aromatic-aliphatic diisocyanate having 8 to 15 carbon atoms (excluding a carbon in NCO group), and modified products of these diisocyanates.

As the diisocyanate component for UPS, a trivalent or higher-valent polyisocyanate may be used in addition to the diisocyanates. The polyvalent isocyanates for UPS may be used singly or in combination.

Examples of the aromatic diisocyanate include 1,3- and/or 1,4-phenylene diisocyanate, 2,4- and/or 2,6-tolylene diisocyanate (TDI), 2,4'- and/or 4,4'-diphenylmethane diisocyanate (MDI), polyallyl polyisocyanate (PAPI), 1,5-naphthylene diisocyanate, 4,4',4"-triphenylmethane triisocyanate, and m- and p-isocyanatophenylsulfonyl isocyanate.

Examples of the aliphatic diisocyanate include ethylene diisocyanate, tetramethylene diisocyanate, hexamethylene diisocyanate (HDI), dodecamethylene diisocyanate, 1,6,11-undecane diisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-dicyanatohexanoate.

Examples of the alicyclic diisocyanate include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and/or 2,6-norbornane diisocyanate.

Examples of the aromatic-aliphatic diisocyanate include m- and/or p-xylylene diisocyanate (XDI), and $\alpha,\alpha,\alpha',\alpha'$-tetramethylxylylene diisocyanate.

Examples of the modified product of diisocyanate include products modified with urethane group, carbodiimide group, allophanate group, urea group, biuret group, uretdione group, uretimine group, isocyanurate group, and oxazolidone group. Specifically, examples thereof include urethane-modified MDI, urethane-modified TDI, carbodiimide-modified MDI, and trihydrocarbyl phosphate-modified MDI, and the modified products of diisocyanate may be used singly or in combination.

[Non-Crystalline Resin]

The non-crystalline resin is a resin that exhibits distinct endothermic peak observed in DSC.

As the non-crystalline resin constituting the binder resin, a vinyl resin formed of an ethylenic unsaturated monomer (vinyl monomer) is preferable, and specifically a styrene-acrylic resin is preferable.

When the non-crystalline resin is a vinyl resin, when the crystalline resin is a crystalline polyester resin, the phases of the non-crystalline resin and the crystalline polyester resin are separated during storage of toner particles. Accordingly, compatiblization the desired sharp-melting property because of the crystalline polyester resin can be obtained by the compatiblization between both the resins during heat fixing. Therefore, excellent low temperature fixability can be achieved. In addition, the recrystallization of the crystalline resin is achieved due to the cooling after the heat fixing to allow the phases of both the resins to be separated. Therefore, it becomes possible to suppress the occurrence of the offset in the obtained fixed image.

Examples of the ethylenic unsaturated monomer for the vinyl resin include styrenes such as styrene, methylstyrene, dimethylstyrene, methoxystyrene, and methoxyacetoxystyrene; (meth)acrylates such as methyl(meth)acrylate, ethyl (meth)acrylate, n-butyl(meth)acrylate, and 2-ethylhexyl (meth)acrylate; carboxyl group-containing vinyl monomers such as (meth)acrylic acid, itaconic acid, maleic acid and fumaric acid, and half alkyl esters thereof; and acrylic amides such as (meth)acrylic amide, and isopropyl(meth) acrylic amide. Among these, styrenes, (meth)acrylates, and carboxyl group-containing vinyl monomers are preferable. The ethylenic unsaturated monomers may be used singly or in combination.

[Molecular Weight of Non-Crystalline Resin]

The molecular weight of the non-crystalline resin measured by gel permeation chromatography (GPC) is preferably 10,000 to 70,000 in terms of weight-average molecular weight (Mw). When the molecular weight of the non-crystalline resin is within the above range, both sufficient low temperature fixability and excellent high-temperature storability can be securely achieved. The measurement of the molecular weight of the non-crystalline resin by GPC is carried out in the same manner as described above except that the non-crystalline resin is used as a measurement sample.

[Glass Transition Point of Non-Crystalline Resin]

The glass transition point of the non-crystalline resin (TgAm) is preferably 40° C. to 80° C., and more preferably 45° C. to 70° C. When the glass transition point of the non-crystalline resin is 40° C. or higher, sufficient thermal strength is imparted to the toner, enabling sufficient high-temperature storability to be achieved. In addition, when the glass transition point of the non-crystalline resin is 80° C. or less, sufficient low temperature fixability can be securely achieved.

The glass transition point of the non-crystalline resin (TgAm) is a value measured according to the method (DSC method) specified in Standards of American Society for Testing and Materials (ASTM) D3418-82, using the non-crystalline resin as a measurement sample.

In the toner, the glass transition point of the non-crystalline resin (TgAm) preferably satisfies the following Expression (3) in the relationship with the melting point of the crystalline resin (TmCl). When the following Expression (3) is satisfied, it is possible to securely suppress the occurrence of tacking or document offset, while achieving a sharp-melting property, and thus sufficient low temperature fixability.

$$TgAm < TmCl \qquad \text{Expression (3)}$$

[Release Agent]

The release agent is not limited, and various known release agents can be used. Examples of the release agents include mineral-based waxes such as montan wax, petroleum-based waxes such as paraffin wax and microcrystalline wax, synthetic waxes such as Fischer-Tropsch wax, polyethylene wax and polypropylene wax, and synthetic ester waxes such as a compound synthesized by an esterification reaction of a fatty acid and an alcohol. Specific examples of the synthetic ester waxes include behenyl behenate, stearyl behenate, glyceryl tribehenate, and pentaerythritol tetrabehenate.

The content ratio of the release agent per 100 parts by mass of the binder resin is preferably 1 to 30 parts by mass, and more preferably 5 to 20 parts by mass. When the content ratio of the release agent is within the above range, sufficient fixation separability is achieved.

One example of the method in which the release agent is introduced into the toner particle when the non-crystalline resin is, for example, a vinyl resin is a method in which an ethylenic unsaturated monomer for forming the non-crystalline resin is added into an aqueous medium in the presence of microparticles of the release agent, followed by polymerization to give binder resin microparticles in which the release agent microparticles are covered with the vinyl resin, which binder resin microparticles are then subjected to the steps of aggregation and fusion in the process for producing the toner to be described later to aggregate and fuse them together with the other material such as microparticles containing the crystalline resin, colorant microparticles, and the like.

Alternatively, there is a method in which microparticles only composed of the release agent are aggregated and fused in the aqueous medium together with other materials such as the binder resin microparticles and the colorant microparticles.

In addition, when the non-crystalline resin is, for example, a vinyl resin, a method may be employed in which the release agent is dissolved or heat-melted in the ethylenic unsaturated monomer for forming the non-crystalline resin, which dissolved or heat-melted release agent is added into an aqueous surfactant solution, with a mechanical energy such as mechanical stirring or an ultrasonic energy being imparted to emulsify the solution, and then a radical polymerization initiator is added for polymerization to give composite microparticles of the release agent and the non-crystalline resin, which composite microparticles may be subjected to the steps of aggregation and fusion.

The melting point of the release agent (TmW) is preferably 60° C. to 90° C. The melting point of the release agent is measured in the same manner as that described above except that the release agent is used as a measurement sample.

In the toner, the melting point of the release agent (TmW) is preferably higher than the glass transition point of the non-crystalline resin (TgAm) and the melting point of the crystalline resin (TmCl), and further preferably satisfies the following Expression (4). When the following Expression (4) is satisfied, the document offset resistance, tacking resistance, or the like in a fixed image as well as a sufficient sharp-melting property can be achieved concurrently.

$$TgAm < TmCl < TmW \qquad \text{Expression (4)}$$

[Colorant]

As the colorant, commonly known dyes and pigments can be used. As colorants for obtaining black toners, it is possible to use any of various known black colorants such as carbon blacks such as furnace black and channel black, magnetic materials such as magnetite and ferrite, dyes, and inorganic pigments including non-magnetic iron oxide.

As colorants for obtaining color toners, it is possible to use any of known color colorants such as dyes and organic pigments, and specific examples of the organic pigments can include C.I. Pigment Red 5, 48:1, 48:2, 48:3, 53:1, 57:1, 81:4, 122, 139, 144, 149, 166, 177, 178, 222, 238, and 269; C.I. Pigment Yellow 14, 17, 74, 93, 94, 138, 155, 180, and 185; C.I. Pigment Orange 31, and 43; C.I. Pigment Blue 15:3, 60, and 76; and the like. Examples of the dyes can include C.I. Solvent Red 1, 49, 52, 58, 68, 11, and 122; C.I. Solvent Yellow 19, 44, 77, 79, 81, 82, 93, 98, 103, 104, 112, and 162; C.I. Solvent Blue 25, 36, 69, 70, 93, and 95; and the like.

The colorants for a toner may be used singly or in combination for each color. The content ratio of the colorant per 100 parts by mass of the binder resin is preferably 1 to 20 parts by mass, and more preferably 4 to 15 parts by mass.

[Component for Constituting Toner Particle]

The toner particles according to the present invention may contain an internal additive such as a charge control agent as necessary, other than the binder resin, the colorant and the release agent.

[Charge Control Agent]

As the charge control agent, various known compounds can be used. The content ratio of the charge control agent per 100 parts by mass of the binder resin is typically set to 0.1 to 5.0 parts by mass.

[Average Particle Diameter of Toner]

The average particle diameter of the toner, in terms of, for example, volume-based median diameter, is preferably 3 to 9 μm, and more preferably 3 to 8 μm. When, for example, an emulsion aggregation method to be described later is employed to produce the toner, the average particle diameter can be controlled depending on the concentration of an aggregation agent, the addition amount of an organic solvent, fusing time, the composition of a polymer, and the like. When the volume-based median diameter is within the above range, the transfer efficiency becomes higher, to allow the quality of halftone images as well as the image quality of thin lines and dots to be enhanced.

The volume-based median diameter of the toner particle is measured and calculated using a measuring apparatus in which a computer system with data processing software "Software V3. 51" being installed therein is connected to "Multisizer 3" (manufactured by Beckman Coulter, Inc.).

Specifically, 0.02 g of toner is added to 20 mL of a surfactant solution (e.g., a surfactant solution obtained by 10-fold dilution of a neutral detergent including a surfactant component with pure water, for the purpose of dispersing toner particles) and wetted, followed by ultrasonic dispersion for 1 minute to prepare a toner dispersion liquid, which toner dispersion liquid is injected into a beaker containing "ISOTON II" (manufactured by Beckman Coulter, Inc.) in a sample stand, with a pipette, until the concentration of the toner indicated by the measuring apparatus reaches 8%. Here, this concentration range makes it possible to give reproducible measurement values.

Using the measuring apparatus, under conditions of the measured particle count number of 25,000 and an aperture diameter of 50 μm, the measurement range of 1 to 30 μm is divided into 256 parts, the frequency on a volume basis for each of the parts is calculated, and the particle size at which the cumulative volume percent passing from the larger particle-size side reaches 50% is determined as the volume-based median diameter.

[Particle Size Distribution of Toner]

As for the toner according to the present invention, the coefficient of variation (Cv value) of the toner particles in the volume-based particle size distribution is preferably 2 to 25%, and more preferably 5 to 23%.

The coefficient of variation (Cv value) in the volume-based particle size distribution indicates the degree of dispersion in the particle size distribution of the toner particles, and is defined by the following Expression (Cv). In the following expression, σ represents a standard deviation in the number particle size distribution, and μ represents a median diameter in the number particle size distribution.

$$\text{Cv value}(\%)=\sigma/\mu\times100 \qquad \text{Expression (Cv)}$$

The Cv value indicates that if the Cv value becomes smaller, the particle size distribution becomes sharper, and the particle size of the toner particles is more uniform. That is, when the Cv value is within the above range, toner particles of uniform size can be obtained. Accordingly, it becomes possible to reproduce finer dot images or thin lines which are required in the electrophotographic image formation with high accuracy.

[Average Circularity of Toner Particle]

The average circularity of each individual toner particle constituting the toner is preferably 0.930 to 1.000, and more preferably 0.950 to 0.995, from the viewpoint of enhancing the transfer efficiency.

In the present invention, the average circularity of the toner particles is measured by "FPIA-2100" (manufactured by Sysmex Corporation).

Specifically, the sample (toner particle) is wetted with an aqueous solution containing a surfactant, and is dispersed via ultrasonic dispersion treatment for 1 minute, followed by photographing with "FPIA-2100" (manufactured by Sysmex Corporation) in an HPF (high magnification imaging) mode at an appropriate concentration of the HPF detection number of 3,000 to 10,000 as a measuring condition. The circularity of each individual toner particle is calculated according to the following Expression (T), and the circularities of the respective toner particles are summed, which summed circularities are divided by the total number of the toner particles to calculate the average circularity of the toner particle. In the following expression, L1 represents the circumference length of a circle having a projection area equal to that of a particle image, and L2 represents the circumference length of the projection of the particle.

$$\text{Circularity}=L1/L2 \qquad \text{Expression (T)}$$

[Softening Point of Toner]

The softening point of the toner is preferably 80 to 120° C., and more preferably 90 to 110° C., from the viewpoint of imparting low temperature fixability to the toner.

The softening point of the toner is measured using a flow tester as indicated below. Specifically, 1.1 g of a sample (toner) is first fed into a petri dish and flattened, followed by being left to stand for 12 hours or longer in an environment of 20° C. and 50% RH, and then the sample is pressurized using a molding machine "SSP-10A" (manufactured by Shimadzu Corporation) for 30 seconds with a force of 3,820 kg/cm' to prepare a molded sample having a cylindrical shape with a diameter of 1 cm. Next, the molded sample is extruded from an aperture (1 mm diameter×1 mm) of a cylindrical die using a piston with a diameter of 1 cm from the time of the completion of preheating, under conditions of a load of 196 N (20 kgf), a starting temperature of 60° C., a preheating time of 300 seconds, and a temperature-elevating rate of 6° C./min. using a flow tester "CFT-500D" (manufactured by Shimadzu Corporation) in an environment of 24° C. and 50% RH to measure an offset method temperature (Toffset) using melt temperature measuring method of the temperature-elevating method at an offset value of 5 mm, which Toffset is designated as the softening point.

[External Additive]

While the toner particles as they are can form the toner, external additives such as a fluidizer and a cleaning auxiliary which are so-called post treatment agents may be added to the toner particles to form the toner, in order to improve fluidity, electrification property, cleaning property, and the like.

Examples of the post treatment agents include inorganic oxide microparticles including silica microparticles, alumina microparticles and titanium oxide microparticles, inorganic stearic acid compound microparticles such as aluminum stearate microparticles and zinc stearate microparticles, and inorganic titanic acid compound microparticles such as strontium titanate microparticles and zinc titanate microparticles. The post treatment agents may be used singly or in combination.

These inorganic microparticles are preferably subjected to surface treatment using a silane coupling agent, a titanium coupling agent, a higher fatty acid, a silicone oil, or the like, in order to enhance high-temperature storability and environmental stability.

The total addition amount of these various external additives is generally 0.05 to 5 parts by mass, and preferably 0.1 to 3 parts by mass based on 100 parts by mass of the toner. In addition, various external additives may be used in combination.

According to the above-described toner, the compatiblization between the crystalline resin and the non-crystalline resin in toner particles and the compatiblization between the crystalline resin and the non-crystalline resin in a fixed image after heat fixing are in a specific range, thereby making it possible to achieve sufficient high-temperature storability while achieving excellent low temperature fixability and wider fixing temperature window, and to form a fixed image with the occurrence of offset or tacking being suppressed.

These effects are considered to be achieved for the following reasons. That is, first, the phases of the crystalline resin and the non-crystalline resin are approximately separated during storage of the toner, and thus the lowering of the glass transition point caused by the compatiblization between both the resins is suppressed to allow high-temperature storability to be achieved. In addition, both the resins become compatible during heat fixing, and thus a sharp-melting property due to the crystalline resin is obtained to allow excellent low temperature fixability to be achieved. Further, the crystalline resin is recrystallized with high probability during cooling after the heat fixing, and thus the phases of the crystalline resin and the non-crystalline resin are separated again in a fixed image to suppress the occurrence of the offset or tacking.

[Process for Producing Toner]

The process for producing the toner includes the steps of aggregating and fusing microparticles containing the binder resin, microparticles containing the colorant, and microparticles containing the release agent dispersed in an aqueous medium.

In the microparticles containing the binder resin, the crystalline resin microparticles are preferably coated with the non-crystalline resin. In addition, in the microparticles containing the release agent, the release agent microparticles are preferably coated with the non-crystalline resin.

As a specific example of the process for producing the toner, a case where the crystalline resin is UMCP and the non-crystalline resin is the vinyl resin will be set forth below.

The process for producing the toner includes the steps of:

(1) dispersing the colorant in an aqueous medium to prepare a dispersion liquid of colorant microparticles;

(2-1) dispersing UMCP in an aqueous medium to prepare a dispersion liquid of UMCP microparticles;

(2-2) dispersing the release agent in an aqueous medium to prepare a dispersion liquid of release agent microparticles;

(3) mixing the dispersion liquid of UMCP microparticles with the dispersion liquid of release agent microparticles and adding an ethylenic unsaturated monomer, as necessary, containing a toner particle constituent component such as a charge control agent, followed by polymerization, to thereby afford binder resin microparticles A in which the UMCP microparticles are coated with the vinyl resin and binder resin microparticles B in which the release agent microparticles are coated with the vinyl resin;

(4) aggregating and fusing the binder resin microparticles A and B and the colorant microparticles in an aqueous medium to form aggregated particles;

(5) aging the aggregated particles with a thermal energy for shape adjustment to produce a dispersion liquid of toner particles;

(6) cooling the dispersion liquid of toner particles;

(7) separating the toner particles from the cooled dispersion liquid of toner particle via solid-liquid separation, and removing a surfactant or the like from the surface of the toner particles; and (8) drying the toner particles washed as mentioned above, and, if necessary, (9) adding an external additive to the toner particles dried as mentioned above.

In the present invention, the term "aqueous medium" means a medium composed of 50 to 100% by mass of water and 0 to 50% by mass of a water-soluble organic solvent. Examples of the water-soluble organic solvent include methanol, ethanol, isopropanol, butanol, acetone, methyl ethyl ketone, and tetrahydrofuran, and an alcohol organic solvent is preferable because it does not dissolve an obtained resin.

(1) Step of Preparing Dispersion Liquid of Colorant Microparticles

The dispersion liquid of colorant microparticles can be prepared by dispersing a colorant in an aqueous medium. The dispersion treatment of the colorant is preferably carried out in such a state where the concentration of a surfactant is set equal to or more than critical micelle concentration (CMC) in the aqueous medium, when the colorant is dispersed uniformly. Various known dispersers can be used for the dispersion treatment of the colorant.

[ Surfactant]

As the surfactant, an anionic surfactant, a cationic surfactant and a nonionic surfactant can be used, and the anionic surfactant is preferable. Examples of the anionic surfactant include dodecyl sodium sulfate, polyoxyethylene (2) lauryl ether sodium sulfate, and dodecyl benzene sodium sulfonate.

The dispersion diameter of the colorant micropsarticles in the dispersion liquid of colorant microparticles to be prepared in the present step is preferably set to 10 to 300 nm in terms of volume-based median diameter. The volume-based median diameter of the colorant microparticles in the dispersion liquid of colorant microparticles is measured with an electrophoretic light scattering photometer "ELS-800" (manufactured by Otsuka Electronics Co., Ltd.).

(2-1) Step of Preparing Dispersion Liquid of UMCP Microparticles

Examples of the method in which UMCP is dispersed in the aqueous medium include a method in which: the UMCP is dissolved or dispersed in an organic solvent to prepare an oil phase liquid; an aqueous medium (aqueous phase) containing a surfactant is provided; the oil phase liquid is added into the aqueous phase; a mechanical shearing force, for example, high-speed stirring, ultrasonic irradiation, or collision against a baffle plate such as Gaulin is used for emulsification to form oil droplets; and, the organic solvent in the oil droplets is removed by, for example, pressure reduction. In this step, when UMCP has an acid value, a basic compound is dissolved into the organic solvent or the aqueous phase in advance, thereby neutralizing a carboxyl group of the UMCP, to thus enable a stable emulsified liquid to be prepared.

In addition, it is also possible to use so-called phase inversion emulsification method in which an aqueous phase is added to the oil phase liquid. When using the phase inversion emulsification method, the basic compound in association with the neutralization of the carboxyl group is preferably dissolved in the organic solvent before use.

As the basic compound that can be dissolved in the aqueous phase, inorganic alkali compounds such as sodium hydroxide, potassium hydroxide, and lithium hydroxide can be used. In addition, as the basic compound that can be dissolved in the organic solvent, organic alkali compounds such as trimethylamine, triethylamine, and tripropylamine can be used.

The amount of the aqueous medium to be used per 100 parts by mass of the oil phase liquid is preferably 50 to 2,000 parts by mass. When the amount of the aqueous medium to be used is set within the above range, it becomes possible to emulsify and disperse the oil phase liquid such that the microparticles have a desired particle diameter in the aqueous medium. Examples of the surfactant to be used include compounds similar to the above-mentioned surfactant.

As the organic solvent to be used for the preparation of the oil phase liquid, a compound having a lower boiling point and a lower solubility to water is preferable in terms of easy removal treatment of oil droplets after their formation, and specific examples thereof include methyl ethyl ketone, metal isobutyl ketone, and ethyl acetate. The organic solvents may be used singly or in combination.

The amount of the organic solvent to be used per 100 parts by mass of UMCP is typically 1 to 300 parts by mass, preferably 1 per 100 parts by mass, and more preferably 25 to 70 parts by mass.

The average particle diameter of the UMCP microparticles obtained in the present step is preferably in the range of, for example, 50 to 500 nm in terms of volume-based median diameter. It is noted that the volume-based median diameter is measured using "UPA-150" (manufactured by Micro Track Co., Ltd.).

(2-2) Step of Preparing Dispersion Liquid of Release Agent Microparticles

A dispersion liquid of release agent microparticles can be prepared by dispersing the release agent in an aqueous medium containing a surfactant. As a disperser to be used for the dispersion treatment of the release agent, various known dispersers can be used. Examples of the surfactant to be used include a compound similar to the above-mentioned surfactant.

The average particle diameter of the release agent microparticles obtained in the present step is preferably in the range of, for example, 50 to 500 nm in terms of volume-based median diameter. It is noted that the volume-based median diameter can be measured using "UPA-150" (manufactured by Micro Track Co., Ltd.).

(3) Step of Forming Binder Resin Microparticles

This step produces binder resin microparticles A in which the UMCP microparticles are coated with the vinyl resin and binder resin microparticles B in which the release agent microparticles are coated with the vinyl resin. Specifically, the ethylenic unsaturated monomer and a radical polymerization initiator are added into an aqueous medium in which the UMCP microparticles and the release agent microparticles are dispersed coexistent, followed by polymerization to thereby concurrently produce binder resin microparticles A in which the UMCP microparticles are coated with the vinyl resin and binder resin microparticles B in which the release agent microparticles are coated with the vinyl resin.

When using a surfactant in this step, examples of the surfactant to be used include, for example, compounds similar to the above-mentioned surfactant.

[Radical Polymerization Initiator]

As the radical polymerization initiator, a water-soluble radical polymerization initiator or oil-soluble radical polymerization initiator can be used.

Examples of the water-soluble radical polymerization initiator include persulfates such as potassium persulfate and ammonium persulfate; azo compounds such as azobis cyano valeric acid, azobis amidinopropane hydrochloride, and azobis amidinopropane acetate; and peroxides such as hydrogen peroxide, and tert-butyl hydroperoxide.

Examples of the oil-soluble radical polymerization initiator include azo compounds such as azobis dimethyl valeronitrile, azobis isobutyronitrile, and dimethyl azobis methyl propionate; and peroxides such as benzoyl peroxide, and methyl ethyl ketone peroxide.

Further, it is also possible to use a redox polymerization initiator in which a radical polymerization initiator that is an oxidizing agent and a reducing agent are combined. The use of the redox polymerization initiator enables the radical formation temperature to be lower than that in the case of using a single radical polymerization initiator, and thus the lowering of the radical polymerization temperature can prevent the non-crystalline resin and the crystalline resin from being compatible, enabling the non-crystalline resin and the crystalline resin to be securely incompatible in toner particles to be obtained.

Examples of the redox polymerization initiator include a composition in which a persulfuric acid compound and sodium metabisulfite are combined, and a composition in which hydrogen peroxide and ascorbic acid are combined.

Among those, it is preferable to use the water-soluble radical polymerization initiator or redox polymerization initiator. Specifically, potassium persulfate, ammonium persulfate, azobis cyano valeric acid, a redox polymerization initiator in which a persulfuric acid compound and sodium metabisulfite are combined, and a redox polymerization initiator in which hydrogen peroxide and ascorbic acid are combined are preferably used.

[Chain Transfer Agent]

In the present step, it is possible to use a generally-used chain transfer agent for the purpose of adjusting the molecular weight of the vinyl resin. The chain transfer agent is not limited, and examples of the chain transfer agent include an alkyl mercaptan, and a mercapto fatty acid ester.

The average particle diameter of the binder resin microparticles obtained in the present step is preferably in the range of, for example, 50 to 500 nm, and more preferably 100 to 300 nm, in terms of volume-based median diameter. It is noted that the volume-based median diameter is measured using "UPA-150" (manufactured by Micro Track Co., Ltd.).

(4) Step of Forming Aggregated Particles

In this step, the colorant microparticles and the binder resin microparticles A and B formed in the above-described steps are aggregated and fused in an aqueous medium. In this step, the dispersion liquids of the binder resin microparticles A and B and the dispersion liquid of the colorant microparticles are added into an aqueous medium, and then, these microparticles are aggregated and fused in the aqueous medium.

The specific method in which the binder resin microparticles A and B and the colorant microparticles are aggregated and fused is a method in which the dispersion liquids of the binder resin microparticles A and B and the dispersion liquid of the colorant microparticles are mixed by stirring, as necessary, carboxyl groups of the binder resin microparticles are dissociated by an alkali, followed by addition of an aggregation agent into an aqueous medium so as to have a concentration equal to or more than a critical aggregation concentration, then the aqueous medium is heated to a temperature which is equal to or higher than the glass transition point of the vinyl resin and which is equal to or higher than the melting point of UMCP, to thereby salt out and fuse the microparticles concurrently in parallel, and particle growth is stopped by adding an aggregation stopping agent at a time when the microparticles are grown to have a desired particle diameter, as necessary, followed by further continued heating for controlling the shape of the particle.

In this method, it is preferable to carry out the heating to a temperature equal to or higher than the glass transition point of the vinyl resin quickly by shortening the time, as much as possible, in which the microparticles are left to stand after the addition of the aggregation agent. The reason for this is not clear, but there is concern that the state of aggregation of the particles may fluctuate to cause the particle diameter distribution to be unstable, or that the surface properties of fused particles may fluctuate, depending on the time when the microparticles are left to stand after being salted out, and it is considered that heating may provide an effective solution to the problem. Typically, the time before the temperature-elevating is preferably within 30 minutes, and more preferably within 10 minutes.

In addition, the temperature-elevating rate is preferably 1° C./min. or higher. The upper limit of the temperature-elevating rate is not limited, but is preferably set within 15° C./min. from the viewpoint of suppressing the occurrence of coarse particles due to the progress of rapid fusing. Further, it is essential to continue the fusing by keeping the temperature of a reaction system for a certain period of time after the reaction system reaches a temperature equal to or higher than the glass transition point. Thus, it becomes possible to both grow and fuse the toner particles effectively, enabling the durability of the toner particles finally obtained to be enhanced.

[Aggregation Agent]

The aggregation agent to be used is not limited, and can be suitably selected from metal salts. Examples of metals of the metal salts include metals of monovalent metal salts like alkali metal salts such as sodium, potassium, and lithium; metals of divalent metal salts such as calcium, magnesium, manganese, and copper; and metals of trivalent metal salts such as iron, and aluminum. Specific examples of the metal salts include sodium chloride, potassium chloride, lithium chloride, calcium chloride, magnesium chloride, zinc chloride, copper sulfate, aluminum chloride, magnesium sulfate, and manganese sulfate. Among those, it is particularly preferable to use a divalent metal salt because aggregation can be allowed to proceed with a smaller amount thereof. The aggregation agents may be used singly or in combination.

In this step, an aggregation stopping agent may be used for stopping the aggregation. When a divalent metal salt or trivalent metal salt is used as the aggregation agent, a monovalent metal salt such as sodium chloride can be used as the aggregation stopping agent. In addition, as the aggregation stopping agent, a chelate compound such as ethylenediaminetetraacetic acid or iminodiacetic acid that forms a metal complex can be used. Further, when the monovalent metal salt is used as the aggregation agent, it is possible to stop the aggregation by setting the metal salt concentration to be lower than the critical aggregation concentration, or by adding an acid to discharge a monovalent metal ion out of the reaction system.

When using a surfactant in this step a compound similar to the above-mentioned surfactant, for example, can be used as the surfactant.

(5) Step of Aging Aggregated Particles

This step is specifically a step of controlling and adjusting the heating temperature, stirring speed, and heating time by heating and stirring the system including aggregated particles until the aggregated particles have desired average circularity in their shapes, to form toner particles having a desired shape. In this step, it is preferable to control the shape of the toner particles with a thermal energy (heating).

(6) Cooling Step, (7) Washing Step, and (8) Drying Step

The cooling, filtering, washing, and drying steps can be carried out by employing various known methods.

(9) Step of Adding External Additive

This step is a step of adding and mixing the external additive to and with toner particles having undergone drying treatment, as necessary. Examples of the method in which the external additive is added include a dry process in which a powdery external additive is added to dried toner particles followed by mixing, and as a mixer, mechanical mixers such as Henschel mixer and coffee mill can be used.

According to the process for producing a toner as described above, it is possible to manufacture the above-mentioned toner.

While an embodiment of the process for producing the toner has been described heretofore specifically, the process for producing the toner is not limited to the above-described examples, and various modifications can be made therein.

For example, the process for producing the toner is not limited to forming both the binder resin microparticles A in which the UMCP microparticles are coated with a vinyl resin and the binder resin microparticles B in which the release agent microparticles are coated with a vinyl resin concurrently, and the process may also form the binder resin microparticles A and B separately. Specifically, the binder resin microparticles A in which crystalline resin microparticles are coated with a non-crystalline resin can be obtained by adding a monomer for forming the non-crystalline resin into an aqueous medium in the presence of the crystalline resin microparticles, followed by polymerization.

Alternatively, for example, the process for producing the toner is not limited to aggregating and fusing both the binder resin microparticles A in which the UMCP microparticles are coated with a vinyl resin and the binder resin microparticles B in which the release agent microparticles are coated with a vinyl resin, and the process may also aggregate and fuse microparticles containing the crystalline resin, the non-crystalline resin and the release agent together instead of the binder resin microparticles A and B. The microparticles containing the crystalline resin, the non-crystalline resin and the release agent together can be obtained by adding a monomer for forming the non-crystalline resin into an aqueous medium in the presence of microparticles in which the crystalline resin and the release agent are mixed and emulsified, followed by polymerization.

[Developer]

While the toner can be used as a magnetic or non-magnetic mono-component developer, it may also be used as a two-component developer by mixing it with a carrier.

As the carrier, it is possible to use magnetic particles made of conventionally known materials like metals such as iron, ferrite and magnetite, and alloys of those metals and metals such as aluminum and lead. Among those, ferrite particles are preferable. In addition, as the carrier, a coated carrier in which the surface of the magnetic particles is coated with a coating agent such as a resin, or a resin-dispersion type carrier in which magnetic microparticles are dispersed in a binder resin may also be used.

The volume average particle diameter of the carrier is preferably 15 to 100 μm, and more preferably 25 to 80 μm.

[Image Forming Apparatus]

The toner can be used for a general electrophotographic image formation method. As the image-forming apparatus that performs such image formation method, for example, it is possible to use an image-forming apparatus including a photoconductor that is an electrostatic latent image carrier, a charging device that gives a uniform electric potential to the surface of the photoconductor with corona discharge having the same polarity as that of the toner, an exposure device that forms an electrostatic latent image by carrying out image exposure on the surface of the uniformly charged photoconductor based on image data, a developing device that conveys the toner to the surface of the photoconductor and visualizes the electrostatic latent image to form a toner image, a transfer device that transfers the toner image onto a transfer material, as necessary, via an intermediate transfer member, and a fixing device that thermally fixes the toner image on the transfer material.

In addition, the toner can be suitably used in the fixing device having a relatively low fixing temperature (surface temperature of fixing member) set at 100° C. to 200° C.

EXAMPLES

Hereinafter, specific examples of the present invention will be described, but the present invention is not limited thereto.

Synthesis Example of CPDO [1]

Diol component: 430 parts by mass of 1,6-hexanediol, dicarboxylic acid component: 691 parts by mass of sebacic acid, and 2 parts by mass of tetrabutoxy titanate as a polymerization catalyst were fed into a reaction vessel equipped with a stirrer, a heating/cooling device, a thermometer, a condenser, a nitrogen inlet device and a pressure reduction device, while elevating the temperature of a mixture in the reaction vessel to 180° C., and the mixture was allowed to react at the same temperature for 10 hours under a nitrogen stream while distilling off by-produced water. Subsequently, the temperature was gradually elevated to 220° C. to allow the mixture to react for 5 hours under a nitrogen stream while distilling off the by-produced water. Further, the mixture was allowed to react while distilling off the by-produced water under a reduced pressure of 0.007 to 0.026 MPa, and the resulting mixture was taken out at a time when the acid value of the reaction product was 0.1 mgKOH/g to obtain CPDO [1]. The weight-average molecular weight (Mw) of CPDO [1] was 8,000.

Synthesis Examples of CPDO [2] to [6]

CPDO [2] to [6] were synthesized similarly to the above-described synthesis example of CPDO [1] except following the formulation in Table 1 below.

TABLE 1

| | Diol | | Dicarboxylic Acid | | |
|---|---|---|---|---|---|
| CPDO No. | Compound Name | Addition Amount (parts by mass) | Compound Name | Addition Amount (parts by mass) | Mw |
| [1] | 1,6-Hexanediol | 430 | Sebacic Acid | 691 | 8000 |
| [2] | 1,4-Butanediol | 328 | Sebacic Acid | 691 | 8200 |
| [3] | Decanediol | 634 | Dodecanedioic Acid | 787 | 7850 |
| [4] | Dodecanediol | 736 | Dodecanedioic Acid | 787 | 7500 |
| [5] | Nonanediol | 583 | Dodecanedioic Acid | 787 | 8100 |
| [6] | Ethylene glycol | 226 | Sebacic Acid | 691 | 7200 |

Synthesis Example of UMCP [1]

452 parts by mass of CPDO [1], 15 parts by mass of 2,2-dimethylolpropionic acid and 500 parts by mass of methyl ethyl ketone were charged into a reaction vessel equipped with a stirrer, a heating/cooling device, a thermometer, a condenser, a nitrogen inlet device and a pressure reduction device, followed by stirring at 60° C. for 1 hour. To the obtained solution was added 33 parts by mass of hexamethylene diisocyanate, and the obtained mixture was allowed to react at 80° C. for 12 hours. Subsequently, 13 parts by mass of anhydrous trimellitic acid and 0.5 parts by mass of tetrabutoxy titanate as a catalyst were fed into the reaction vessel, while elevating the temperature to 120° C., and the mixture was allowed to react for 5 hours, followed by distilling off methyl ethyl ketone to obtain UMCP [1].

The weight-average molecular weight (Mw) of UMCP [1] was 34,000, and the acid value of UMCP [1] was 13 mgKOH/g.

Synthesis Examples of UMCP [2] to [6]

UMCP [2] to [6] were synthesized similarly to the above-described synthesis example of UMCP [1] except that CPDO [2] to [6] were used respectively in place of CPDO [1].

The weight-average molecular weight (Mw), acid value, melting point (Tm) and endotherm ΔHo2 of UMCP [2] to [6] are shown in Table 2 below.

TABLE 2

| UMCP No. | CPDO No. | Mw | AV [mgKOH/g] | Tm [° C.] | ΔHo2 [J/g] |
|---|---|---|---|---|---|
| [1] | [1] | 34000 | 13 | 65 | 72 |
| [2] | [2] | 35000 | 12 | 64 | 62 |
| [3] | [3] | 33000 | 14 | 76 | 88 |
| [4] | [4] | 32000 | 15 | 78 | 89 |
| [5] | [5] | 35500 | 13 | 69 | 92 |
| [6] | [6] | 31500 | 15 | 66 | 58 |

Preparation Example of Dispersion Liquid of UMCP Microparticles [1]

200 parts by mass of UMCP [1] was dissolved into 800 parts by mass of methyl ethyl ketone to prepare a UMCP methyl ethyl ketone solution (20 wt %), to which was added 4.7 parts by mass of triethylamine to neutralize carboxyl groups in UMCP [1] (neutralization degree: 100%). The resulting mixture was stirred at a stirring speed of 8,000 rpm at room temperature, while adding an aqueous surfactant solution in which 8 parts by mass of dodecyl sodium sulfate was dissolved into 800 parts by mass of pure water. After further continuing stirring, methyl ethyl ketone was distilled off at room temperature under reduced pressure, to thereby prepare a dispersion liquid of UMCP microparticles $D_{UMCP}$ [1].

The average particle diameter of microparticles in $D_{UMCP}$ [1] was 220 nm, and the solid content concentration of $D_{UMCP}$ [1] was 20%.

Preparation Examples of $D_{UMCP}$ [2] to [6]

$D_{UMCP}$ [2] to [6] were prepared similarly to the above-described preparation example of $D_{UMCP}$ [1] except that UMCP [2] to [6] were used respectively in place of UMCP [1] and that the addition amount of triethylamine was set to a molar amount corresponding to the acid value of UMCP to be used.

Average particle diameters APDs of microparticles in $D_{UMCP}$ [2] to [6] are shown in Table 3 below.

TABLE 3

| $D_{UMCP}$ No. | UMCP No. | APD [nm] |
|---|---|---|
| [1] | [1] | 220 |
| [2] | [2] | 230 |
| [3] | [3] | 190 |
| [4] | [4] | 180 |
| [5] | [5] | 220 |
| [6] | [6] | 175 |

Preparation Example of Dispersion Liquid of Release Agent Microparticles [W]

200 parts by mass of release agent, behenyl behenate, was warmed to 80° C. to be melted. The melted behenyl behenate was charged into an aqueous surfactant solution kept warmed at 80° C. in which 8 parts by mass of dodecyl sodium sulfate was dissolved into 800 parts by mass of deionized water, followed by carrying out high-speed stirring using "CLEARMIX" (manufactured by M technique Co., Ltd.), and then the obtained mixture was cooled to room temperature, to thereby afford a dispersion liquid of release agent microparticles $D_w$ [W]. The average particle diameter of the microparticles in $D_w$ [W] was 200 nm, and the solid content concentration of $D_w$ [W] was 20%.

Preparation Example of Dispersion Liquid of Binder Resin Microparticles [1]

300 parts by mass of a dispersion liquid of UMCP microparticles [1], 100 parts by mass of $D_w$ [W], 0.1 parts by mass of dodecyl sodium sulfate and 160 parts by mass of deionized water were added into a reactor equipped with a stirrer, a nitrogen inlet tube, a condenser and a thermometer, followed by stirring, and further the internal temperature of the reactor was elevated to 75° C. while stirring under a nitrogen stream. To the obtained mixture, an aqueous polymerization initiator solution in which 1.77 parts by mass of potassium persulfate was dissolved into 33 parts by mass of deionized water was added, and a monomer solution in which 95 parts by mass of styrene, 36 parts by mass of n-butyl acrylate, 9 parts by mass of methacrylic acid and 1.9 parts by mass of n-octyl mercaptan were mixed was added dropwise to the mixture over 1 hour.

Subsequently, the resulting mixture was allowed to react at 75° C. for 5 hours while stirring under a nitrogen stream, and the internal temperature was elevated to 80° C., followed by allowing the mixture to react for further 1 hour. Then, the resulting reaction mixture was cooled to room temperature, to thereby afford a dispersion liquid of binder resin microparticles $D_{BR}$ [1] having binder resin microparticles in which crystalline resin microparticles are coated with a non-crystalline resin and coated-release agent microparticles in which release agent microparticles are coated with a non-crystalline resin, the binder resin microparticles and the coated-release agent microparticles being dispersed together in $D_{BR}$ [1]. In $D_{BR}$ [1], the average particle diameter of the microparticles was 210 nm, the weight-average molecular weight (Mw) of a resin of the binder resin microparticles was 25,000, and the glass transition point was 45° C. The average particle diameter ADP of the microparticles in $D_{BR}$ [1], the weight-average molecular weight Mw of a resin of the binder resin microparticles, and the glass transition point Tg are shown in Table 4.

Preparation Examples of $D_{BR}$ [2] to [6]

$D_{BR}$ [2] to [6] were obtained similarly to the preparation example of $D_{BR}$ [1] except that UMCP [2] to [6] were used respectively in place of UMCP [1].

ADP, Mw and Tg of $D_{BR}$ [2] to [6] are shown in Table 4.

Preparation Examples of $D_{BR}$ [7]

392 parts by mass of a dispersion liquid of composite resin microparticles [A] containing the release agent and UMCP described below, 0.1 parts by mass of dodecyl sodium sulfate and 166 parts by mass of deionized water were added into a reactor equipped with a stirrer, a nitrogen inlet tube, a condenser and a thermometer, followed by stirring, and further the internal temperature of the reactor was elevated to 75° C. while stirring under a nitrogen stream. To the obtained mixture, an aqueous polymerization initiator solution in which 1.77 parts by mass of potassium persulfate was dissolved into 33 parts by mass of deionized water was added, and a monomer solution in which 95 parts by mass of styrene, 36 parts by mass of n-butyl acrylate, 9 parts by mass of methacrylic acid and 1.9 parts by mass of n-octyl mercaptan were mixed was added dropwise to the mixture over 1 hour.

Subsequently, the resulting mixture was allowed to react at 75° C. for 5 hours while stirring under a nitrogen stream, and the internal temperature was elevated to 80° C., followed by allowing the mixture to react for further 1 hour. Then, the obtained reaction mixture was cooled to room temperature, to thereby afford $D_{BR}$ [7] in which binder resin microparticles, in which microparticles composed of a release agent and a crystalline resin are coated with a non-crystalline resin, are dispersed. The ADP, Mw and Tg of $D_{BR}$ [7] are shown in Table 4.

Preparation Example of Dispersion Liquid of Composite Resin Microparticles [A]

100 parts by mass of UMCP [1] and 33 parts by mass of behenyl behenate were heated to 80° C. to give a melt mixture. Likewise, an aqueous surfactant solution in which 5.2 parts by mass of dodecyl sodium sulfate and 2.4 parts by mass of triethylamine were dissolved into 520 parts by mass of deionized water was warmed to 80° C., and the melt mixture was added to the aqueous surfactant solution while stirring. High-speed stirring was carried out using "CLEARMIX" (manufactured by M technique Co., Ltd.), and then the resulting mixture was cooled to room temperature, to thereby afford a dispersion liquid of composite resin microparticles [A] containing a release agent and UMCP. The average particle diameter of the microparticles in the dispersion liquid of composite resin microparticles [A] was 230 nm, and the solid content concentration of the dispersion liquid of composite resin microparticles [A] was 20%.

TABLE 4

| $D_{BR}$ No. | Mw | APD [nm] | Tg [° C.] |
|---|---|---|---|
| [1] | 25000 | 210 | 45 |
| [2] | 24000 | 220 | 44 |
| [3] | 25500 | 185 | 46 |
| [4] | 26000 | 170 | 47 |
| [5] | 24000 | 205 | 46 |
| [6] | 26500 | 165 | 39 |
| [7] | 23000 | 200 | 46 |

Preparation Example of Dispersion Liquid of Colorant Microparticles [Bk]

40 parts by mass of carbon black was added to an aqueous surfactant solution in which 5 parts by mass of dodecyl sodium sulfate was dissolved into 155 parts by mass of deionized water, and high-speed stirring was carried out using "CLEARMIX" (manufactured by M technique Co., Ltd.), to thereby afford a dispersion liquid of colorant microparticles $D_{CA}$ [BK]. The average particle diameter of the colorant microparticles in $D_{CA}$ [BK] was 180 nm, and the solid content concentration of $D_{CA}$ [BK] was 20%.

Example 1: Manufacturing Example of Toner [1]

750 parts by mass of $D_{BR}$ [1], 45 parts by mass of $D_{CA}$ [Bk], 700 parts by mass of deionized water, and 7 parts by mass of polyoxyethylene (2) lauryl ether sodium sulfate (active ingredient: 27%) were charged into a reactor equipped with a condenser, a thermometer and a stirrer, followed by addition of an aqueous 1N-sodium hydroxide solution to the obtained mixture while stirring to adjust the pH of the mixture to 10.

Further, an aqueous magnesium chloride solution in which 20 parts by mass of magnesium chloride hexahydrate was dissolved into 20 parts by mass of deionized water was added dropwise to the mixture, and the temperature of the mixture was elevated to 80° C. while stirring. The temperature was kept at 80° C., followed by conducting sampling while stirring, and the particle diameter in the obtained dispersion liquid was measured using a particle size distribution measuring apparatus "Coulter counter 3" (manufactured by Beckman Coulter, Inc.). At a time when the volume-based median diameter reached 6 μm, an aqueous sodium chloride solution in which 15 parts by mass of sodium chloride was dissolved into 60 parts by mass of deionized water was added to stop the particle diameter growth.

While continuing further heating and stirring, the circularity of the particles in the dispersion liquid was measured using a flow type particle image analyzer "FPIA-2100" (manufactured by Sysmex Corporation), and the dispersion liquid was cooled to room temperature at a time when the average circularity reached 0.96. The dispersion liquid was subjected to repetitive filtration and washing, and then dried, to thereby afford toner particles [1]. The volume-based median diameter $D_{50}$ of the toner particles [1] was 6.18 μm, the coefficient of variation (Cv value) thereof was 19.7%, and the average circularity thereof was 0.967.

(Differential Scanning Calorimetry)

By carrying out DSC on toner particles and UMCPs alone, ΔHo1, ΔHoc, ΔHo2, ΔHt1, ΔHtc and ΔHt2 were measured to calculate the value of (ΔHt2/ΔHt1)/(ΔHo2/ΔHo1) and the value of ΔHtc/(ΔHoc×A/100). The results are shown in Table 6. It is noted that, in the differential scanning calorimetry of toner particles, the melting point of behenyl behenate that is a release agent is 73° C., which does not overlap the melting peak of UMCP according to the present invention, enabling separation.

To the resulting toner particles [1] was added 1.5% by mass of hydrophobic silica (number average primary particle diameter=10 nm, hydrophobicity=60), followed by mixing using "Henschel mixer" (manufactured by NIPPON COKE & ENGINEERING CO., LTD.), and then coarse particles were removed using a sieve with an aperture of 45 μm, to thereby afford toner [1].

Examples 2 to 6, Comparative Example 1

Manufacturing Examples of Toners [2] to [7]

Toners [2] to [7] were obtained similarly to the above-described manufacturing example of toner [1] except that dispersion liquids of binder resin microparticles [2] to [7] were used respectively in place of the dispersion liquid of binder resin microparticles [1], and the hydrophobic silica was mixed similarly to the manufacturing example of the toner [1], to thereby afford toners [2] to [7].

The volume-based median diameter of the toner particles [2] to [7], the coefficient of variation (Cv value) thereof, and the average circularity thereof are shown in Table 5. In addition, the value of (ΔHt2/ΔHt1)/(ΔHo2/ΔHo1) and the value of ΔHtc/(ΔHoc×A/100) are shown in Table 6.

TABLE 5

| Toner Particles No. | $D_{BR}$ No. | $D_{50}$ (μm) | CV Value (%) | Average Circularity |
|---|---|---|---|---|
| [1] | [1] | 6.18 | 19.7 | 0.967 |
| [2] | [2] | 6.09 | 20.3 | 0.968 |
| [3] | [3] | 6.24 | 19.2 | 0.965 |
| [4] | [4] | 6.02 | 19.8 | 0.969 |
| [5] | [5] | 6.28 | 19.1 | 0.961 |
| [6] | [6] | 6.39 | 22.8 | 0.973 |
| [7] | [7] | 6.15 | 19.4 | 0.966 |

TABLE 6

| Toner Particles No. | (ΔHt2/ΔHt1)/ (ΔHo2/ΔHo1) | ΔHtc/ (ΔHoc × A/100) |
|---|---|---|
| [1] | 0.96 | 0.93 |
| [2] | 0.95 | 0.92 |
| [3] | 0.97 | 0.96 |
| [4] | 0.98 | 0.95 |
| [5] | 0.99 | 0.99 |
| [6] | 0.74 | 0.69 |
| [7] | 0.96 | 0.93 |

Manufacturing Examples 1 to 7 of Developer

A ferrite carrier having a volume average particle diameter of 35 μm coated with an acrylic resin was added to each of the toners [1] to [7] so that the toner concentration is 6% by mass, followed by mixing using a V-blender to manufacture developers [1] to [7].

The developers [1] to [7] were evaluated as follows.

(1) Minimum Fixing Temperature

A modified image forming apparatus of "BizHab PRO C6000L" (manufactured by Konica Minolta, Inc.) modified to be able to change the fixing temperature was used to set the fixing temperature of a solid image having a toner deposition amount of 10 g/m$^2$ from 180° C. to 100° C. by every 5° C. and to fix and output the respective solid images on a sheet at a linear velocity of 400 mm/sec., and then the image part of the solid image was folded in a valley shape. Among the fixing temperatures for the solid images in which the image was peeled off and the width of the fold was 0.5 mm or less, the lowest temperature was set as the minimum fixing temperature (MFT).

The results are shown in Table 7. When the minimum fixing temperature is 130° C. or less, the toner is judged to have low temperature fixability and to be acceptable in the present invention.

(2) Hot Offset Temperature and Cold Offset Temperature

The modified image forming apparatus of "BizHab PRO C6000L" (manufactured by Konica Minolta, Inc.) modified to be able to change the fixing temperature was used to set the fixing temperature of a solid image having a toner deposition amount of 10 g/m$^2$ from 180° C. to 100° C. by every 5° C. and to fix and output the respective solid images on a sheet at a linear velocity of 400 mm/sec. The resulting solid images were observed by visual inspection. The lowest numerical value among the fixing temperatures at times when hot offset occurred was set as hot offset temperature (HOT), and the highest numerical value among the fixing temperatures at times when cold offset occurred was set as cold offset temperature (COT).

The results are shown in Table 7. When the hot offset temperature is 175° C., and the cold offset temperature is 120° C. or less, the toner is judged to have offset resistance and to be acceptable in the present invention.

(3) Document Offset Resistance

The modified image forming apparatus of "BizHab PRO C6000L" (manufactured by Konica Minolta, Inc.) modified to be able to change the fixing temperature was used to fix and output two solid images on a sheet having a toner deposition amount of 10 g/m$^2$ at a fixing temperature of 150° C. and at a linear velocity of 400 mm/sec. The resulting two solid images were overlapped to face each other such that the image part of one solid image is superimposed on the non-image part and image part of the other solid image, with a weight equivalent to 80 g/cm$^2$ being placed on the superimposed part, and the images were left to stand for 3 days in a thermostat/humidistat bath with a temperature of 60° C. and a humidity of 50%. After being left to stand, the overlapped two solid images were peeled off, and the degrees of their image losses were classified into levels according to the following evaluation standards, to thereby evaluate the document offset resistance (DOR).

The results are shown in Table 7. When the degrees of their image losses are in the levels of "G3" to "G5", the toner is judged to have document offset resistance and to be acceptable in the present invention.

Evaluation Standard

G1: Because the overlapped two solid image parts are adhered to each other, the image part on the sheet falls together with part of the sheet when the two solid image parts are separated to result in severe image losses, and obvious transfer of images to the non-image part is seen.

G2: Because the overlapped two solid image parts are adhered to each other, there are some voids due to image losses in some areas of the image part.

G3: When the overlapped two images are separated, the roughening and the lowered gloss of images occur on the surface of the respective fixed images. However, the images have almost no image loss, and thus are in an allowable level. Slight transfer of images to the non-image part is seen.

G4: When the overlapped two images are separated, there is a peeling sound, with slight transfer of images to the non-image part being also seen. However, there is no image loss, and the images are in a level with no problem at all.

G5: No image loss or no image transfer is seen at all both in the image part and in the non-image part.

TABLE 7

| | Toner No. | MFT [° C.] | COT [° C.] | HOT [° C.] | DOR |
|---|---|---|---|---|---|
| Ex. 1 | [1] | 125 | 115 | 185 | G5 |
| Ex. 2 | [2] | 130 | 120 | 180 | G4 |
| Ex. 3 | [3] | 115 | 110 | 180 | G5 |
| Ex. 4 | [4] | 120 | 115 | 185 | G5 |
| Ex. 5 | [5] | 115 | 110 | 180 | G5 |
| Comp. Ex. 1 | [6] | 145 | 140 | 165 | G1 |
| Ex. 6 | [7] | 125 | 115 | 185 | G5 |

As is obvious from Table 7, it was confirmed that the developers [1] to [5] and [7] according to the above-described examples had sufficient low temperature fixability and offset resistance. It was also confirmed that the developer [6] according to the comparative example not satisfying Expressions (1) and (2) was inferior in the low temperature fixability and the offset resistance. This is considered to be because, as is obvious from Table 6, the crystalline resin was not sufficiently recrystallized in the cooling process after heat fixing, so that the phase separation between the crystalline resin and the non-crystalline resin were not achieved sufficiently.

INDUSTRIAL APPLICABILITY

According to the toner of the present invention, when the degree of compatiblization of the crystalline resin with the non-crystalline resin in the toner particles and the degree of compatiblization of the crystalline resin with the non-crystalline resin in a fixed image after heat fixing are in a specific range, it becomes possible to achieve sufficient high-temperature storability while achieving excellent low temperature fixability and to form a fixed image with the occurrence of offset or tacking being suppressed. In addition, according to the process of producing the toner of the present invention, it becomes possible to securely produce the toner.

What is claimed is:

1. A toner for developing an electrostatic latent image, comprising toner particles containing a binder resin, a colorant, and a release agent, wherein the binder resin comprises a non-crystalline resin and a crystalline resin, the toner satisfying the following Expressions (1) and (2):

$$0.95(\Delta Ht2/\Delta Ht1)/(\Delta Ho2/\Delta Ho1)\leq 1.0 \quad \text{Expression (1):}$$

$$0.9\ \Delta Htc/(\Delta Hoc\times A/100)\leq 1.0 \quad \text{Expression (2):}$$

where, ΔHo1 represents the endotherm (J/g) of the crystalline resin determined by a melting peak in a first differential scanning calorimetry (DSC) curve of the crystalline resin, the first DSC curve obtained in a first heating process of elevating the temperature of the crystalline resin from 0° C. to 200° C. by DSC, ΔHoc represents the endotherm (J/g) of the crystalline resin determined by a melting peak in the first DSC curve obtained in a cooling process of lowering the temperature of the crystalline resin from 2000C to 0° C., ΔHo2 represents the endotherm (J/g) of the crystalline resin determined by a melting peak in the first DSC curve obtained in a second heating process of elevating the temperature of the crystalline resin from 0° C. to 200° C., ΔHt1 represents the endotherm (J/g) of the crystalline resin in the toner particles determined by a melting peak in a second DSC curve of the toner particles obtained in a first heating step of elevating the temperature of the toner particles from 0° C. to 200° C. by DSC, ΔHtc represents the endotherm (J/g) of the crystalline resin in the toner particles determined by a melting peak in the second DSC curve obtained in a cooling step of lowering the temperature of the toner particles from 200° C. to 0° C., ΔHt2 represents the endotherm (J/g) of the crystalline resin in the toner particles determined by a melting peak in the second DSC curve obtained in a second heating step of elevating the temperature of the toner particles from 0° C. to 200° C., and A represents the content ratio (% by mass) of the crystalline resin in the toner particles, wherein the crystalline resin is a urethane-modified crystalline resin in which a urethane crystalline polymerization segment is bonded to a crystalline polymerization segment, and a peak temperature of the melting peak in the first DSC curve obtained in the second heating process is within the range of 60° C. to 90° C., wherein the urethane-modified crystalline resin is a urethane-modified crystalline polyester resin, and the crystalline polymerization segment thereof comprises a crystalline aliphatic polyester polymer, and wherein one or both of at least one polymer terminal of the urethane-modified crystalline polyester resin and the urethane polymerization segment of the urethane-modified crystalline polyester resin has a carboxyl group, and an acid value of the urethane-modified crystalline polyester resin is within the range of 7 to 20 mgKOH/g.

2. The toner according to claim 1, wherein the non-crystalline resin comprises a vinyl resin, and the toner satisfies the following Expression (3):

$$TgAm<TmCl \quad \text{Expression (3):}$$

where, TgAm represents a glass transition point of the non-crystalline resin, and TmCl represents a peak temperature of the melting peak of the crystalline resin obtained in the second heating process.

3. A process for producing the toner according to claim 1, comprising: aggregating and fusing microparticles containing the binder resin, microparticles containing the colorant, and microparticles containing the release agent dispersed in an aqueous medium.

4. The process for producing the toner according to claim 3, comprising: adding a monomer for the non-crystalline resin into an aqueous medium in the presence of microparticles of the crystalline resin and polymerizing the monomer to afford the microparticles containing the binder resin.

5. The process for producing the toner according to claim 3, comprising: adding a monomer for the non-crystalline resin into an aqueous medium in the presence of both microparticles of the crystalline resin and microparticles of the release agent and polymerizing the monomer to afford both the microparticles containing the binder resin and the microparticles containing the release agent simultaneously.

6. A process for producing the toner according to claim 1, comprising: aggregating and fusing microparticles containing the binder resin and the release agent, and microparticles containing the colorant dispersed in an aqueous medium.

7. The process for producing the toner according to claim 6, comprising: adding a monomer for forming the non-crystalline resin into an aqueous medium in the presence of microparticles comprising both the emulsified crystalline resin and the emulsified releasing agent and polymerizing the monomer to afford the microparticles containing both the binder resin and the release agent.

* * * * *